United States Patent [19]

Ohashi et al.

[11] Patent Number: 4,770,194

[45] Date of Patent: Sep. 13, 1988

[54] METHOD OF MANUFACTURING WRINKLED SHEET TOBACCO

[75] Inventors: Yukinari Ohashi; Norio Furuya; Satoru Kataoka, all of Hiratsuka; Masataka Watanabe, Yokohama, all of Japan

[73] Assignee: Japan Tobacco, Inc., Tokyo, Japan

[21] Appl. No.: 932,513

[22] PCT Filed: Mar. 22, 1985

[86] PCT No.: PCT/JP85/00138

§ 371 Date: Nov. 7, 1986

§ 102(e) Date: Nov. 7, 1986

[87] PCT Pub. No.: WO86/05366

PCT Pub. Date: Sep. 25, 1986

[30] Foreign Application Priority Data

| | | | |
|---|---|---|---|
| Sep. 26, 1983 | [JP] | Japan | 58-176436 |
| Oct. 25, 1983 | [JP] | Japan | 58-198300 |
| Nov. 4, 1983 | [JP] | Japan | 58-205984 |
| Nov. 4, 1983 | [JP] | Japan | 58-205985 |
| Dec. 23, 1983 | [JP] | Japan | 58-242089 |
| Dec. 23, 1983 | [JP] | Japan | 58-242090 |

[51] Int. Cl.[4] ..... A24B 3/14

[52] U.S. Cl. ..... 131/375

[58] Field of Search ..... 131/375, 355, 370

[56] References Cited

U.S. PATENT DOCUMENTS

| | | | |
|---|---|---|---|
| 2,887,414 | 5/1959 | Rosenberg et al. . | |
| 3,430,634 | 3/1969 | Schweitzer et al. . | |
| 4,497,331 | 2/1985 | Nellen | 131/370 |

FOREIGN PATENT DOCUMENTS

| | | |
|---|---|---|
| 525814 | 10/1954 | Belgium . |
| 48-5919 | 2/1973 | Japan . |
| 58-11994 | 3/1983 | Japan . |
| 60-70059 | 4/1985 | Japan . |
| 60-91975 | 5/1985 | Japan . |
| 2070410 | 9/1981 | United Kingdom . |

*Primary Examiner*—V. Millin

*Attorney, Agent, or Firm*—Nixon & Vanderhye

[57] ABSTRACT

In a method of manufacturing wrinkled sheet tobacco by wetting a raw material powder containing tobacco with water, extruding the resultant wet powder through a gap between a pair of rollers, and separating sheet tobacco attached to the surface of one roller with a doctor knife, one of the substances selected from those enumerated below is added to the raw material powder in an amount specified below: (1) 4 to 10% by weight of an α-starch or propylene glycol alginate ester, (2) 4 to 11% by weight of a hydrolyzed starch having a molecular weight of 100,000 to 900,000, gum arabic, a carboxymethyl cellulose salt having a molecular weight of 10,000 to 20,000, or a high methoxyl pectin having a degree of methoxylation of 7 to 17% and a degree of esterification of 62 to 77%, and (3) a mixture of 1.9 to 7.9% by weight of a 4,4,6-triglucosaccharide polymer and 1.3 to 3.2% by weight of sodium carboxymethyl cellulose.

9 Claims, 1 Drawing Sheet

METHOD OF MANUFACTURING WRINKLED SHEET TOBACCO

TECHNICAL FIELD

The present invention relates to a method of manufacturing a tobacco sheet used as a raw material for cigarettes or the like. More particularly, the present invention relates to a method of manufacturing sheet tobacco obtained by binding tobacco waste, such as tobacco powder, with a binder to produce large wrinkles.

BACKGROUND ART

So-called cut tobacco obtained by cutting tobacco leaves is used for usual tobacco articles such as cigarettes. In the step of cutting tobacco leaves or in other tobacco manufacturing steps, various types of tobacco waste such as leaf waste, cut waste, powder tobacco, or rib waste are produced. Conventionally, in order to effectively utilize such tobacco waste, it is bound to a suitable binder, and added with a reinforcing agent, a humectant, and the like. The mixture is extruded through a gap between a pair of rollers to form a sheet, and the sheet attached to the surface of one roller is separated therefrom with a doctor knife to obtain sheet tobacco (See Japanese Patent Publication No. 48-5919). The sheet tobacco is cut and mixed with normal cut tobacco and used as a raw material for cigarettes and the like.

When sheet tobacco manufactured in the above manner has wrinkles, it has considerable filling capacity (i.e., is bulky) when cut. Therefore, the amount of cut tobacco rolled as cigarettes can be reduced, resulting in economical advantages. In the above-mentioned method, when the sheet is separated by the doctor knife, wrinkles are formed in the sheet. However, as shown in FIG. 1, wrinkles formed in sheet tobacco in this manner are small wrinkles having a pitch of 0.1 to 0.2 mm and a height including the sheet thickness of about 0.2 mm when sheet tobacco having a thickness of 0.1 mm is used. Therefore, this sheet does not provide sufficient filling capacity when cut. Japanese Patent Publication No. 48-5919, mentioned above, discloses the use of a special doctor knife for forming large wrinkles. However, large wrinkles can be formed for only a short period of time due to wear on the doctor knife.

DISCLOSURE OF INVENTION

It is an object of the present invention to provide a method of manufacturing sheet tobacco which has great filling capacity, in which large wrinkles can be formed even after a doctor knife becomes worn.

The above object is achieved by using a specified amount of a specified substance as a binder. Thus, there is provided according to the present invention a method of manufacturing wrinkled sheet tobacco by wetting a raw material powder containing tobacco with water, extruding the resultant wet powder through a gap between a pair of rollers, and separating sheet tobacco attached to the surface of one roller with a doctor knife, wherein one of the substances selected from those enumerated below is added to the raw material powder in an amount defined below. The amount defined below is an amount based on the overall weight of the powder before wetting with water (i.e., the total weight of the raw material powder):

(1) 4 to 10% by weight of an α-starch or propylene glycol alginate ester;

(2) 4 to 11% by weight of a hydrolyzed starch having a molecular weight of 100,000 to 900,000, gum arabic, a carboxymethyl cellulose salt having a molecular weight of 10,000 to 20,000, or a high methoxyl pectin having a degree of methoxylation of 7 to 17% and a degree of esterification of 62 to 77%; and (3) a mixture of 1.9 to 7.9% by weight of a 4,4,6-triglucosaccharide polymer and 1.3 to 3.2% by weight of sodium carboxymethyl cellulose.

When a predetermined amount of one of the substances enumerated above is added as a binder to the raw material powder, sheet tobacco having large wrinkles with a pitch of about 2 mm and a height of about 1 mm can be obtained. Wrinkles formed by the method of the present invention are different from those formed by conventional methods in that small wrinkles are present in large wrinkles to provide a greater filling capacity, as shown in FIG. 2. In addition, the method of the present invention does not require a special doctor knife, as in Japanese Patent Publication No. 48-5919, and allows formation of large wrinkles even upon considerable wear of the doctor knife. Sheet tobacco prepared by the method of the present invention has excellent water resistance, and provides good taste when smoked, as will be described with reference to Examples to be described later.

BEST MODE OF CARRYING OUT THE INVENTION

Figure 1:
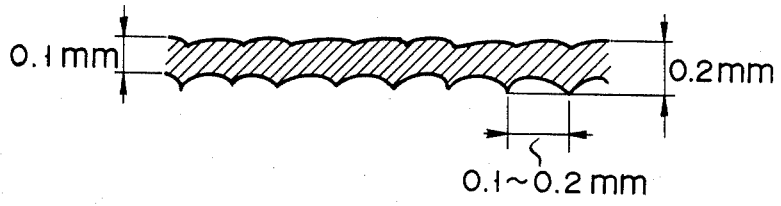
FIG. 1 is a sectional view schematically showing the size and shape of sheet tobacco obtained by a conventional method.

According to the method of the present invention, a raw material powder containing tobacco, such as tobacco waste, is prepared and is wetted with water. Like a conventional raw material powder, the raw material powder used in the present invention contains tobacco, such as tobacco waste or rib waste, a binder, and optionally additives such as a humectant, a reinforcing agent, and a water resistance agent. Water is added thereto in order to wet the raw material (i.e., to provide a suitable water content). The most important characteristic of the present invention is that a specified amount of the specified substance is used as the binder. The following substances can be used as the binder herein:

(1) α-starch;

(2) propylene glycol alginate ester;

(3) hydrolyzed starch having a molecular weight of 100,000 to 900,000;

(4) gum arabic;

(5) a salt of a carboxymethyl cellulose having a molecular weight of 10,000 to 20,000 (a sodium salt, a potassium salt, or the like);

(6) high methoxyl pectin having a degree of methoxylation of 7 to 17% and a degree of esterification of 62 to 77%; and (7) a mixture of a 4,4,6-triglucosaccharide polymer (pullulan) and sodium carboxymethyl cellulose A binder selected from those enumerated above must be used in a specified amount. More specifically, when substance (1) or (2) above is used, it must be used in an amount of 4 to 10% by weight based on the total weight of the raw material powder (i.e., the total weight of the powder before addition of water). When any one of substances (3) to (6) is used, it must be used in an amount of 4 to 11% by weight based on the above-mentioned total weight. When substance (7) is used, it must be used such that 4,4,6-triglucosaccharide polymer is 1.9 to 7.9% by weight, and sodium carboxymethyl cellulose is 1.3 to 3.2% by weight.

Other components of the raw material powder according to the present invention are the same as those used in conventional one. More specifically, tobacco can be selected from various tobacco wastes, including leaf waste, cut waste, tobacco powder, rib waste, and winnower waste. The raw material powder contains tobacco in an amount of 50 to 98%, and preferably 70 to 95%. As in conventional methods, the raw material powder can also contain suitable amounts of a humectant, a reinforcing agent, a water resistance agent, and the like. The humectant can, for example, be a mixture of propylene glycol and corn syrup (in a weight ratio of, e.g., 1:2). The reinforcing agent can be, e.g., fibrillated pulp. The water resistance agent can be, e.g., glyoxal or the like.

The wet raw material powder is prepared by mixing these respective components to provide a raw material powder and then adding water to the powder to obtain a suitable water content of the wet raw material powder. The wet raw material powder has a water content of 30 to 70%, and preferably 40 to 60%.

Figure 3:
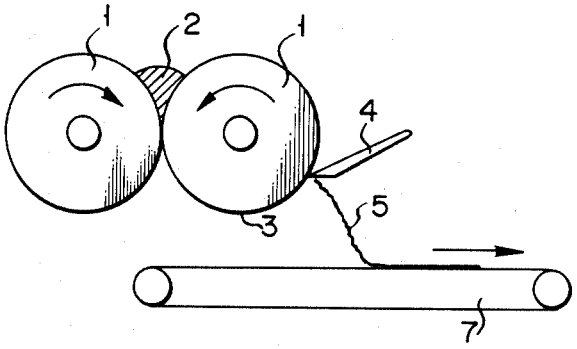
FIG. 3 is a schematic diagram for explaining the method of the present invention.

As shown in FIG. 3, wet raw material powder 2 thus prepared is extruded as a sheet from a gap between a pair of rollers 1, which rotate in opposite directions. Preferably, the peripheral speed of the rollers is 20 m/min or more, and, more preferably, 70 m/min or more. The gap between rollers 1 is normally selected to be about 0.1 mm.

When the wet powder is extruded through the gap between rollers 1, resultant sheet 3 is attached to the surface of one roller. Sheet 3 is then removed from roller 1 with doctor knife 4. Separated sheet 5 is then placed on belt conveyor 7 and is conveyed to the next processing area.

Figure 2:
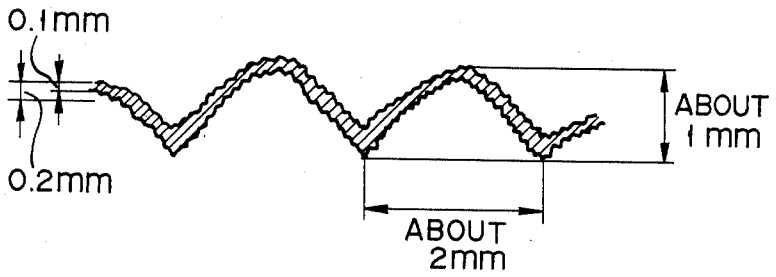
FIG. 2 is a sectional view schematically showing the size and shape of sheet tobacco obtained by the method of the present invention.

According to the method of the present invention, separated sheet 5 has large wrinkles, as shown in FIG. 2. In addition, small wrinkles are formed in the large wrinkles to increase the filling capacity. The wrinkled sheet tobacco manufactured by the method of the present invention has a filling capacity of 35 to 42 $cm^3$ when tested by a filling capacity test described in Test Example 1 below. When a water resistance test, also described in Test Example 1, is performed, the sheet tobacco of the present invention has a shape retention property for 30 minutes or longer. The wrinkled sheet tobacco prepared in this manner is cut and mixed with raw materials for e.g., cigarettes.

TEST EXAMPLE 1

The components shown in Tables 1 and 2 were mixed in the mixing ratios shown in the Tables. Water was added to each mixture to provide a wet raw material powder having a water content of 30%. Each wet powder was supplied to a gap between a pair of rollers rotating in opposite directions at a peripheral speed of 75 m/min. Each sheet tobacco attached to one roller was separated therefrom with a doctor knife, was placed on a belt conveyor, and was fed into a drier. Sheet tobaccos having a water content of 11% by weight and a thickness of 0.1 mm were thus prepared. The sheets were cut into widths of 0.8 mm and lengths of 10 mm to provide cut tobaccos.

Using the respective cut tobacco, obtained in this manner, an increase in filling capacity, with reference to that of Control cut tobacco, was measured. Filling capacity was measured according to the following procedures. Fifteen grams of each cut tobacco were charged into a cylindrical container having an inner diameter of 72 mm and were compressed at a constant speed of 0.5 mm/sec, and the capacity of the tobacco was measured when a stress reaches 250 g/cm. The capacity of the Control cut tobacco was also measured under the same conditions. The percentage of the capacity of each tobacco of the present invention with respect to that of the Control cut tobacco was calculated. The capacity of the Control cut tobacco was 33 $cm^3$.

The increase in water resistance of the sheet tobaccos obtained in the above manner was measured according to the following procedures. One hundred and fifty milliliters of warm water at 30° C. were poured into petri dishes having a diameter of 20 mm. The sheet tobaccos were cut into a circular form having a diameter of 30 mm and were placed in the respective petri dishes. The petri dishes were shaken horizontally six times per minute at an amplitude of 16 mm five seconds for intervals of 5 seconds. The time required for tearing the circular sheet tobaccos into three or more pieces was measured, and is expressed in % with reference to the Control sheet tobacco. The Control sheet tobacco had a water resistance (time) of 10 minutes.

The powder as a raw material for the control sheet tobacco and the control cut tobacco had the following composition: 54% of raw material waste tobacco, 35% of winnower waste, 3% of sodium carboxymethyl cellulose, 2% of glyoxal, 3% of propylene glycol, 3% of sorbitol, and water in an amount to provide a water content of 60%.

TABLE 1

| | Comparative Example | | Example | | | | Comparative Example | | Example | |
|---|---|---|---|---|---|---|---|---|---|---|
| | 1 | 2 | 1 | 2 | 3 | 4 | 3 | 4 | 5 | 6 |
| Component | | | | | | | | | | |
| Binder 1*[1] | 2 | 3 | 4 | 6 | 9 | 10 | 11 | | | |
| Binder 2*[2] | | | | | | | | 3 | 4 | 6 |
| Binder 3*[3] | | | | | | | | | | |
| Binder 4*[4] | | | | | | | | | | |
| Binder 5*[5] | | | | | | | | | | |
| Binder 6*[6] | | | | | | | | | | |
| Tobacco waste 1*[7] | 54 | 53 | 53 | 52 | 51 | 50 | 49 | 53 | 53 | 52 |
| Tobacco waste 2*[8] | 18 | 18 | 17 | 17 | 16 | 16 | 16 | 18 | 17 | 17 |
| Reinforcing material*[9] | 11 | 11 | 11 | 10 | 10 | 10 | 10 | 11 | 11 | 10 |

TABLE 1-continued

| | | | | | | | | | | |
|---|---|---|---|---|---|---|---|---|---|---|
| Humectant*10 | 12 | 12 | 12 | 12 | 11 | 11 | 11 | 12 | 12 | 12 |
| Water resistance agent*11 | 3 | 3 | 3 | 3 | 3 | 3 | 3 | 3 | 3 | 3 |
| Filling capacity increase (%) | (−) | −5 | 17 | 20 | 23 | 23 | (−) | −7 | 5 | 8 |
| Water resistance increase (%) | (−) | 80 | 100 | 120 | 180 | 200 | (−) | 60 | 80 | 100 |

| | Example | | Comparative Example | Example | | | | Comparative Example | | |
|---|---|---|---|---|---|---|---|---|---|---|
| | 7 | 8 | 5 | 9 | 10 | 11 | 12 | 6 | 7 | 8 |
| Component | | | | | | | | | | |
| Binder 1*1 | | | | | | | | | | |
| Binder 2*2 | 9 | 10 | 11 | | | | | | | |
| Binder 3*3 | | | | 4 | 6 | 9 | 10 | | | |
| Binder 4*4 | | | | | | | | 6 | | |
| Binder 5*5 | | | | | | | | | 6 | |
| Binder 6*6 | | | | | | | | | | 6 |
| Tobacco waste 1*7 | 51 | 50 | 49 | 53 | 52 | 51 | 50 | 52 | 52 | 52 |
| Tobacco waste 2*8 | 16 | 16 | 16 | 17 | 17 | 16 | 16 | 17 | 17 | 17 |
| Reinforcing material*9 | 10 | 10 | 10 | 11 | 10 | 10 | 10 | 10 | 10 | 10 |
| Humectant*10 | 11 | 11 | 11 | 12 | 12 | 11 | 11 | 12 | 12 | 12 |
| Water resistance agent*11 | 3 | 3 | 3 | 3 | 3 | 3 | 3 | 3 | 3 | 3 |
| Filling capacity increase (%) | 10 | 10 | (−) | 7 | 11 | 12 | 12 | −10 | −11 | −13 |
| Water resistance increase (%) | 140 | 160 | (−) | 110 | 130 | 190 | 210 | 17 | 0 | 0 |

TABLE 2

| | Comparative Example | | Example | | | | | Comparative Example | | |
|---|---|---|---|---|---|---|---|---|---|---|
| | 9 | 10 | 13 | 14 | 15 | 16 | 17 | 11 | 12 | 13 |
| Component | | | | | | | | | | |
| Binder 7*12 | 6 | | | | | | | | | |
| Binder 8*13 | | 3 | 4 | 6 | 9 | 10 | 11 | 12 | | |
| Binder 9*14 | | | | | | | | | 6 | |
| Binder 10*15 | | | | | | | | | | 6 |
| Tobacco waste 1 | 52 | 53 | 53 | 52 | 51 | 50 | 49 | 48 | 52 | 52 |
| Tobacco waste 2 | 18 | 17 | 17 | 16 | 16 | 16 | 16 | 18 | 17 | 17 |
| Reinforcing material*9 | 10 | 11 | 11 | 10 | 10 | 10 | 10 | 10 | 10 | 10 |
| Humectant*10 | 12 | 12 | 12 | 12 | 11 | 11 | 11 | 11 | 12 | 12 |
| Water resistance agent*11 | 3 | 3 | 3 | 3 | 3 | 3 | 3 | 3 | 3 | 3 |
| Filling capacity increase (%) | −5 | −6 | 9 | 12 | 13 | 13 | 13 | (−) | −13 | −25 |
| Water resistance increase (%) | −17 | 0 | 10 | 17 | 25 | 28 | 33 | (−) | 20 | 25 |

*1α-starch (corn)
*2α-starch (potato)
*3α-starch (tapioca)
*4Dialdehyde starch
*5Etherified starch
*6Phosphate starch
*7Raw material waste tobacco fine powder
*8Rib/winnower waste powder
*9Fibrillated pulp
*10Propylene glycol and corn syrup (weight ratio: 1:2)
*11Glyoxal
*12Hydrolyzed potato starch having a molecular weight of 10,000 to 90,000
*13Hydrolyzed potato starch having a molecular weight of 100,000 to 900,000
*14Hydrolyzed potato starch having a molecular weight of 1,000,000 to 9,000,000
*15Hydrolyzed potato starch having a molecular weight of 10,000,000 to 90,000,000
Marks (−) indicate that the formation state is poor due to tearing of the sheet or incomplete sheet separation As can be seen from the results shown in Table 1, when one of the α-starches is used as the binder in an amount of 4 to 10% by weight, many wrinkles like those shown in FIG. 2 can be formed, and the filling capacity increases by 5 to 23% over that of conventional sheet tobacco, although each different starch has a slightly different filling capacity-increasing degree. Water resistance is also increased by 80 to 210%. In contrast to this, when dialdehyde starch, etherified starch, or phosphate starch is used as the binder, no wrinkles are formed, filling capacity is lower than that of conventional sheet tobacco, and no increase in water resistance is observed.

As can be seen from the results shown in Table 2, when a hydrolyzed starch having a molecular weight of 100,000 to 900,000 is used in an amount of 4 to 11% by weight as the binder, many wrinkles like those shown in FIG. 2 are formed. The filling capacity increases by 9 to 13% and the water resistance increases by 10 to 33% over those of conventional sheet tobacco. When a hydrolyzed starch having a molecular weight of 10,000 to 90,000, i.e., a higher degree of hydrolysis, is used, the filling capacity and water resistance are poorer than those of conventional sheet tobacco. When a hydrolyzed starch having a molecular weight of 1,000,000 to 9,000,000, i.e., a lower degree of hydrolysis, is used, no wrinkles are formed and filling capacity is still poorer.

TEST EXAMPLE 2

Six panelists smoked cut tobaccos of Example 2, Example 6, Example 10 and Example 14, and the Control cut tobacco, and evaluated the aroma, taste, peculiarity in taste, and stimulation in accordance with a ±3 point method. The evaluation standards were as follows:

+3: much better than Control
+2: significantly better than Control
+1: slightly better than Control
0: equivalent to Control
−1: slightly poorer than Control
−2: significantly poorer than Control −3: much poorer than Control The results obtained are shown in Table 3 below. Values in the Table are average values of the six panelists.

TABLE 3

| | Aroma | Taste | Peculiarity | Stimulation |
|---|---|---|---|---|
| Control | 0 | 0 | 0 | 0 |
| Example 2 | +1.5 | +0.8 | 0 | 0 |
| Example 6 | +1.3 | +1.0 | +0.2 | +1.0 |
| Example 10 | +1.0 | +0.7 | +1.3 | −0.2 |
| Example 14 | +0.5 | +0.8 | +1.3 | +1.0 |

It is seen from Table 3 that the tobaccos manufactured by the method of the present invention have qualities, such as aroma, taste, peculiarity in taste, or stimulation, that are equivalent to or better than those of conventional tobacco.

TEST EXAMPLE 3

The components shown in Table 4 were mixed in the mixing ratios shown in the Table. Water was added to the mixture to provide wet raw material powders having a water content of 30%. Each wet powder was treated following the same procedures as in Test Example 1, and the filling capacity increase in the resultant sheet tobacco was measured. The obtained results are shown in Table 4.

TABLE 4

| | Comparative Example | | Example | | | | Comparative Example | | | | |
|---|---|---|---|---|---|---|---|---|---|---|---|
| | 14 | 15 | 18 | 19 | 20 | 21 | 16 | 17 | 18 | 19 | 20 |
| Component | | | | | | | | | | | |
| Binder 11*16 | 2 | 3 | 4 | 6 | 9 | 10 | 11 | | | | |
| Binder 12*17 | | | | | | | | 3 | 6 | | |
| Binder 13*18 | | | | | | | | | | 3 | 6 |
| Tobacco waste 1 | 47 | 46 | 46 | 45 | 44 | 43 | 43 | 46 | 45 | 46 | 45 |
| Tobacco waste 2 | 25 | 25 | 24 | 24 | 23 | 23 | 22 | 25 | 24 | 25 | 24 |
| Reinforcing material*9 | 11 | 11 | 11 | 10 | 10 | 10 | 10 | 11 | 10 | 11 | 10 |
| Humectant*10 | 12 | 12 | 12 | 12 | 11 | 11 | 11 | 12 | 12 | 12 | 12 |
| Water resistance agent*11 | 3 | 3 | 3 | 3 | 3 | 3 | 3 | 3 | 3 | 3 | 3 |
| Filling capacity increase (%) | −15 | −12 | 9 | 14 | 15 | 15 | (−) | −15 | −15 | −15 | −15 |

*16Propylene glycol alginate ester
*17Sodium alginate
*18Potassium alginate

As is apparent from the results shown in Table 4, when propylene glycol alginate ester is used in an amount of 4 to 10% by weight as the binder, many wrinkles like those shown in FIG. 2 are formed, and the filling capacity increases by 9 to 15% over conventional wrinkled sheet tobacco. In contrast to this, when sodium alginate or potassium alginate is used, no wrinkles are formed and the filling capacity is poorer than that of conventional wrinkled sheet tobacco.

The different results obtained in accordance with the different types of binder are assumed to be attributed to the physiochemical properties of the binders, such as flowability, adherence, or contraction.

TEST EXAMPLE 4

The components shown in Table 5 were mixed in the mixing ratios shown in the Table. Water was added to the mixtures to provide wet raw material powders having a water content of 30%. Each wet powder was treated following the same procedures as in Test Example 1, and the filling capacity increase in the resultant sheet tobacco was measured. The results obtained are shown in Table 5.

TABLE 5

| | Comparative Example | | Example | | | | | Comparative Example | | | | | | |
|---|---|---|---|---|---|---|---|---|---|---|---|---|---|---|
| | 21 | 22 | 22 | 23 | 24 | 25 | 26 | 23 | 24 | 25 | 26 | 27 | 28 | 29 |
| Component | | | | | | | | | | | | | | |
| Binder 14*19 | 2 | 3 | 4 | 6 | 9 | 10 | 11 | 12 | | | | | | |
| Binder 15*20 | | | | | | | | | 3 | 6 | | | | |
| Binder 16*21 | | | | | | | | | | | 3 | 6 | | |
| Binder 17*22 | | | | | | | | | | | | | 3 | 6 |
| Tobacco waste 1 | 47 | 46 | 46 | 45 | 44 | 43 | 43 | 42 | 46 | 45 | 46 | 45 | 46 | 45 |
| Tobacco waste 2 | 25 | 25 | 24 | 24 | 23 | 23 | 22 | 22 | 25 | 24 | 25 | 24 | 25 | 24 |
| Reinforcing material*9 | 11 | 11 | 11 | 10 | 10 | 10 | 10 | 10 | 11 | 10 | 11 | 10 | 11 | 10 |
| Humectant*10 | 12 | 12 | 12 | 12 | 11 | 11 | 11 | 11 | 12 | 12 | 12 | 12 | 12 | 12 |
| Water resistance agent*11 | 3 | 3 | 3 | 3 | 3 | 3 | 3 | 3 | 3 | 3 | 3 | 3 | 3 | 3 |
| Filling capacity increase (%) | −15 | −6 | 6 | 8 | 9 | 9 | 9 | (−) | −15 | −7 | −15 | −15 | −15 | −15 |

*19Carboxymethyl cellulose salt having a molecular weight of 10,000 to 20,000
*20Carboxymethyl cellulose salt having a molecular weight of 22,000 to 30,000
*21Carboxymethyl cellulose salt having a molecular weight of 40,000 to 50,000
*22Carboxymethyl cellulose salt having a molecular weight of 100,000 to 150,000

As can be seen from the results shown in Table 5, when a carboxymethyl cellulose salt having a molecular weight of 10,000 to 20,000, is used in an amount of 4 to 11% by weight as the binder, many wrinkles like those shown in FIG. 2 are formed, and the filling capacity increases by 6 to 9% over conventional wrinkled sheet tobacco. In contrast to this, when a carboxymethyl cellulose salt having a molecular weight of 22,000 to 30,000 is used, no substantial effect is obtained. When a carboxymethyl cellulose salt having a molecular weight of 40,000 to 50,000 or 100,000 to 150,000 (conventional) is used, no wrinkles are formed and the filling capacity is poorer than conventional wrinkled sheet tobacco.

TEST EXAMPLE 5

The components shown in Table 6 were mixed in the mixing ratios shown in the Table. Water was added to the mixtures to provide wet raw material powders having a water content of 30%. Each wet powder was treated following the same procedures as in Test Example 1, and the filling capacity increase in the resultant sheet tobacco was measured. The results obtained are shown in Table 6.

TABLE 6

| | Comparative Example | | Example | | | | Comparative Example | | | | |
|---|---|---|---|---|---|---|---|---|---|---|---|
| | 30 | 31 | 27 | 28 | 29 | 30 | 32 | 33 | 34 | 35 | 36 |
| Component | | | | | | | | | | | |
| Binder 18*23 | 2 | 3 | 4 | 6 | 9 | 11 | 12 | | | | |
| Binder 19*24 | | | | | | | | 3 | 6 | | |
| Binder 20*25 | | | | | | | | | | 3 | 6 |
| Tobacco waste 1 | 47 | 46 | 46 | 45 | 44 | 43 | 42 | 46 | 45 | 46 | 45 |
| Tobacco waste 2 | 25 | 25 | 24 | 24 | 23 | 22 | 22 | 25 | 24 | 25 | 24 |
| Reinforcing material*9 | 11 | 11 | 11 | 10 | 10 | 10 | 10 | 11 | 10 | 11 | 10 |
| Humectant*10 | 12 | 12 | 12 | 12 | 11 | 11 | 11 | 12 | 12 | 12 | 12 |
| Water resistance agent*11 | 3 | 3 | 3 | 3 | 3 | 3 | 3 | 3 | 3 | 3 | 3 |
| Filling capacity increase (%) | −15 | −9 | 8 | 15 | 16 | 16 | (−) | −15 | −13 | −15 | −15 |

*23Gum arabic
*24locust bean gum
*25Guar gum

As can be seen from the results in Table 6, when gum arabic is used in an amount of 4 to 11% by weight as the binder, many wrinkles like those shown in FIG. 2 are formed, and the filling capacity increases by 8 to 16% over conventional wrinkled sheet tobacco. In contrast to this, when a natural gum, either locust bean gum or guar gum, is used, no wrinkles are formed and the filling capacity is poorer than conventional wrinkled sheet tobacco.

TEST EXAMPLE 6

The components shown in Table 7 were mixed in the mixing ratios shown in the Table. Water was added to the mixtures to provide wet raw material powders having a water content of 30%. Each wet powder was treated following the same procedures as in Test Example 1, and the filling capacity increase in the resultant sheet tobacco was measured. The obtained results obtained are shown in Table 7.

TABLE 7

| | Comparative Example | | | | | Example | | | | Comparative Example |
|---|---|---|---|---|---|---|---|---|---|---|
| | 37 | 38 | 39 | 40 | 41 | 31 | 32 | 33 | 34 | 42 |
| Component | | | | | | | | | | |
| Binder 21*26 | 4 | 6 | 11 | | | | | | | |
| Binder 22*27 | | | | 2 | 3 | 4 | 6 | 9 | 11 | 12 |
| Binder 23*28 | | | | | | | | | | |
| Binder 24*29 | | | | | | | | | | |
| Binder 25*30 | | | | | | | | | | |
| Binder 26*31 | | | | | | | | | | |
| Tobacco waste 1*7 | 46 | 45 | 43 | 47 | 46 | 46 | 45 | 44 | 43 | 42 |
| Tobacco waste 2*8 | 24 | 24 | 22 | 25 | 25 | 24 | 24 | 23 | 22 | 22 |
| Reinforcing material*9 | 11 | 10 | 10 | 11 | 11 | 11 | 10 | 10 | 10 | 10 |
| Humectant*10 | 12 | 12 | 11 | 12 | 12 | 12 | 12 | 11 | 11 | 11 |
| Water resistance agent*11 | 3 | 3 | 3 | 3 | 3 | 3 | 3 | 3 | 3 | 3 |
| Filling capacity increase (%) | −15 | −15 | −13 | −15 | −12 | 14 | 18 | 19 | 19 | (−) |

| | Example | | | | | | | | | | Comparative Example | |
|---|---|---|---|---|---|---|---|---|---|---|---|---|
| | 35 | 36 | 37 | 38 | 39 | 40 | 41 | 42 | 43 | 44 | 43 | 44 |
| Component | | | | | | | | | | | | |
| Binder 21*26 | | | | | | | | | | | | |
| Binder 22*27 | | | | | | | | | | | | |
| Binder 23*28 | 4 | 6 | 11 | | | | | | | | | |
| Binder 24*29 | | | | 4 | 6 | 11 | | | | | | |
| Binder 25*30 | | | | | | | 4 | 6 | 9 | 11 | | |
| Binder 26*31 | | | | | | | | | | | 3 | 6 |
| Tobacco waste 1*7 | 46 | 45 | 43 | 46 | 45 | 43 | 46 | 45 | 44 | 43 | 46 | 45 |
| Tobacco waste 2*8 | 24 | 24 | 22 | 24 | 24 | 22 | 24 | 24 | 23 | 22 | 25 | 24 |
| Reinforcing material*9 | 11 | 10 | 10 | 11 | 10 | 10 | 11 | 10 | 10 | 10 | 11 | 10 |
| Humectant*10 | 12 | 12 | 11 | 12 | 12 | 11 | 12 | 12 | 11 | 11 | 12 | 12 |
| Water resistance agent*11 | 3 | 3 | 3 | 3 | 3 | 3 | 3 | 3 | 3 | 3 | 3 | 3 |
| Filling capacity increase (%) | 15 | 17 | 20 | 14 | 17 | 19 | 12 | 13 | 15 | 17 | −15 | −15 |

*26High methoxyl pectin having a degree of methoxylation of 7 to 17% and a degree of esterification of 53 to 61%
*27High methoxyl pectin having a degree of methoxylation of 7 to 17% and a degree of esterification of 62 to 66%
*28High methoxyl pectin having a degree of methoxylation of 7 to 17% and a degree of esterification of 66 to 70%
*29High methoxyl pectin having a degree of methoxylation of 7 to 17% and a degree of esterification of 71 to 74%
*30High methoxyl pectin having a degree of methoxylation of 7 to 17% and a degree of esterification of 74 to 77%
*31Low methoxyl pectin (degree of methoxylation below 7%)

As can be seen from Table 7, when a high methoxyl pectin having a degree of methoxylation of 7 to 17% and a degree of esterification of 62 to 77% is used as the binder, many wrinkles like those shown in FIG. 2 are formed, and the filling capacity increases by 12 to 20% over conventional sheet tobacco, although each different high methoxyl pectin has a slightly different filling capacity-increasing degree. In contrast to this, when a low methoxyl pectin having a degree of methoxylation below 17% or a high methoxyl pectin having an esterification degree lower limit below 62% is used, no wrinkles are formed and the filling capacity is poorer than conventional wrinkled sheet tobacco.

TEST EXAMPLE 7

The components shown in Table 8 were mixed in the mixing ratios shown in the Table. Water was added to the mixtures to provide wet raw material powders having a water content of 30%. Each wet powder was treated following the same procedures as in Test Example 1, and the filling capacity increase in the resultant sheet tobacco was measured. The results obtained are shown in Table 8.

TABLE 8

| | Comparative Example | | | Example | | | | | | |
|---|---|---|---|---|---|---|---|---|---|---|
| | 45 | 46 | 47 | 43 | 44 | 45 | 46 | 47 | 48 | 49 |
| Component | | | | | | | | | | |
| Binder 27*32 | 0 | 0.6 | 1.3 | 1.9 | 1.9 | 1.9 | 3.2 | 4.4 | 6.2 | 7.9 |
| Binder 28*33 | 2.0 | 2.0 | 1.9 | 1.3 | 1.9 | 3.2 | 1.9 | 1.9 | 1.9 | 1.8 |
| Tobacco waste 1*7 | 54.2 | 53.9 | 53.7 | 53.7 | 53.3 | 52.6 | 52.6 | 51.9 | 50.9 | 50.0 |
| Tobacco waste 2*8 | 17.8 | 17.7 | 17.6 | 17.6 | 17.4 | 17.2 | 17.2 | 17.0 | 16.6 | 16.4 |
| Reinforcing material*9 | 10.9 | 10.8 | 10.7 | 10.7 | 10.7 | 10.5 | 10.5 | 10.4 | 10.2 | 10.0 |
| Humectant*10 | 11.8 | 11.7 | 11.6 | 11.6 | 11.6 | 11.4 | 11.4 | 11.3 | 11.1 | 10.9 |
| Water resistance*11 | 3.0 | 3.0 | 3.0 | 3.0 | 3.0 | 3.0 | 3.0 | 3.0 | 3.0 | 3.0 |
| Filling capacity increase (%) | −15 | −11 | −2 | 10 | 12 | 15 | 18 | 21 | 22 | 22 |
| Water resistance increase (%) | 0 | 7 | 16 | 12 | 25 | 25 | 33 | 38 | 45 | 67 |

| | Comparative Example | | | | | | | | |
|---|---|---|---|---|---|---|---|---|---|
| | 48 | 49 | 50 | 51 | 52 | 53 | 54 | 55 | 56 |
| Component | | | | | | | | | |
| Binder 27*32 | 9.0 | 2.0 | 3.2 | 4.5 | 5.7 | 6.9 | 8.0 | 9.2 | 10.2 |
| Binder 28*33 | 1.8 | 0 | 0 | 0 | 0 | 0 | 0 | 0 | 0 |
| Tobacco waste 1*7 | 49.4 | 54.2 | 53.9 | 52.9 | 52.3 | 51.6 | 49.9 | 50.2 | 49.7 |
| Tobacco waste 2*8 | 16.2 | 17.7 | 17.5 | 17.3 | 17.1 | 16.9 | 16.7 | 16.5 | 16.3 |
| Reinforcing material*9 | 9.9 | 10.9 | 10.7 | 10.6 | 10.4 | 10.3 | 10.2 | 10.1 | 9.9 |
| Humectant*10 | 10.7 | 11.9 | 11.6 | 11.5 | 11.3 | 11.2 | 11.1 | 10.9 | 10.7 |
| Water resistance*11 | 3.0 | 3.0 | 3.0 | 3.0 | 3.0 | 3.0 | 3.0 | 3.0 | 3.0 |
| Filling capacity increase (%) | (−) | (−) | 4 | 7 | 9 | 10 | 11 | 11 | (−) |
| Water resistance increase (%) | (−) | (−) | −45 | −33 | −24 | −15 | −11 | −6 | (−) |

*32 4,4,6-triglucosaccharide polymer
*33 sodium carboxymethyl cellulose

As can be seen from the results shown in Table 8, when a 4,4,6-triglucosaccharide polymer is used in an amount of 3.2 to 9.2% by weight as the binder, wrinkles are formed, but water resistance is poorer though the filling capacity increases by 4 to 11% over conventional wrinkled sheet tobacco. In contrast to this, when a mixture of 1.9 to 7.9% of a 4,4,6-triglucosaccharide polymer and 1.3 to 3.2% of sodium carboxymethyl cellulose is used as the binder, many wrinkles are formed, the sheet strength is increased, and the filling capacity and water resistance increase by 10 to 22% and 12 to 67%, respectively, over conventional wrinkled sheet tobacco.

We claim:

1. A method of manufacturing wrinkled sheet tobacco by wetting a raw material powder containing tobacco with water, extruding the resultant wet powder through a gap between a pair of rollers, and separating sheet tobacco attached to the surface of one roller with a doctor knife, wherein the raw material powder contains a binder comprising:

(1) 4 to 10% by weight of an a-starch; or (2) 4 to 10% by weight of propylene glycol alginate ester; or (3) 4 to 11% by weight of a hydrolyzed starch having a molecular weight of 100,000 to 900,000; or (4) 4 to 11% by weight of gum arabic; or (5) 4 to 11% by weight of a carboxymethyl cellulose salt having a molecular weight of 10,000 to 20,000; or (6) 4 to 11% by weight of a high methoxyl pectin having a degree of methoxylation of 7 to 17% and a degree of esterification of 62 to 77%; or (7) a mixture of 1.9 to 7.9% by weight of a 4,4,6-triglucosaccharide polymer and 1.3 to 3.2% by weight of sodium carboxymethyl cellulose.

2. A method according to claim 1, wherein a rotating speed of the rollers, in terms of a peripheral speed, is not less than 20 m/min.

3. A method according to claim 1, wherein the binder is an α-starch added in an amount of 4 to 10% by weight based on the weight of the raw material powder.

4. A method according to claim 1, wherein the binder is a hydrolyzed starch having a molecular weight of 100,000 to 900,000 added in an amount of 4 to 11% by weight based on the weight of the raw material powder.

5. A method according to claim 1, wherein the binder comprises 1.9 to 7.9% by weight of a 4,4,6-triglucosaccharide polymer and 1.3 to 3.2% by weight of sodium carboxymethyl cellulose.

6. A method according to claim 1, wherein the binder comprises propylene glycol alginate ester added in an amount of 4 to 10% by weight based on the weight of the raw material powder.

7. A method according to claim 1 wherein the binder comprises gum arabic added in amount of 4 to 11% by weight based on the weight of the raw material powder.

8. A method according to claim 1, wherein the binder comprises a carboxymethyl cellulose salt having a molecular weight of 10,000 to 20,000 added in an amount of 4 to 11% by weight based on the weight of the raw material powder.

9. A method according to claim 1, wherein the binder comprises a high methoxyl pectin having a degree of esterification of 62 to 77% added in an amount of 4 to 11% by weight based on the weight of the raw material powder.

* * * * *

UNITED STATES PATENT AND TRADEMARK OFFICE

CERTIFICATE OF CORRECTION

PATENT NO. : 4,770,194

DATED : September 13, 1988

INVENTOR(S) : OHASHI et al

It is certified that error appears in the above-identified patent and that said Letters Patent is hereby corrected as shown below:

Please delete the following in its entirety as it appears on the first page of the above-identified patent.

"[30] Foreign Application Priority Data

| | | |
|---|---|---|
| Sep. 26, 1983 [JP] | Japan | 58-176436 |
| Oct. 25, 1983 [JP] | Japan | 58-198300 |
| Nov. 4, 1983 [JP] | Japan | 58-205984 |
| Nov. 4, 1983 [JP] | Japan | 58-205985 |
| Dec. 23, 1983 [JP] | Japan | 58-242089 |
| Dec. 23, 1983 [JP] | Japan | 58-242090" |

Signed and Sealed this

Thirtieth Day of May, 1989

*Attest:*

*Attesting Officer*

DONALD J. QUIGG

*Commissioner of Patents and Trademarks*